US005402919A

United States Patent [19]

Atkinson

[11] Patent Number: 5,402,919

[45] Date of Patent: Apr. 4, 1995

[54] LEVER DEVICE TO EASE VALVE OPERATION ON LIQUID BAG CONTAINERS

[76] Inventor: Robert L. Atkinson, 4367 N. Capistrano, Dallas, Tex. 75287

[21] Appl. No.: 251,909

[22] Filed: Jun. 1, 1994

[51] Int. Cl.[6] ..... B67D 3/00

[52] U.S. Cl. ..... 222/505; 222/105; 222/402.15

[58] Field of Search ..... 222/92, 105, 402.15, 222/505, 508, 509; 251/228-229, 243, 321, 231, 236

[56] References Cited

U.S. PATENT DOCUMENTS

| | | | |
|---|---|---|---|
| 2,941,700 | 6/1960 | Gable | 222/509 X |
| 3,159,319 | 12/1964 | Parish | 222/509 X |
| 3,313,516 | 4/1967 | Peterson | 251/243 X |
| 3,314,577 | 4/1967 | Doblin | 222/402.15 X |
| 3,478,938 | 11/1969 | Krause | 222/402.15 X |
| 3,539,151 | 11/1970 | Reid et al. | 251/321 X |
| 3,972,452 | 8/1976 | Welsh | 222/505 X |
| 4,905,875 | 3/1990 | Straiton | 222/505 |
| 4,938,386 | 7/1990 | Roethel et al. | 222/92 |

FOREIGN PATENT DOCUMENTS

| | | | |
|---|---|---|---|
| 1228142 | 3/1960 | France | 222/402.15 |

*Primary Examiner*—Andres Kashnikow
*Assistant Examiner*—Kenneth Bomberg

[57] ABSTRACT

A lever for the application of a force to a resilient component of vacuum bag-in-box fluid containers to facilitate fluid flow. Lever has a linear body having a relatively short arm for engaging the resilient component, at one of its ends and extending normally therefrom. Projecting outwardly from the body in a sense opposite to that of the arm is an angular member or protrusion for preventing overrotation of the lever during use. A bore in the body, positioned between the arm and angular member, permits the pivotal attachment of a D-shaped wire loop for securing the lever to the fluid valve during use.

1 Claim, 1 Drawing Sheet

LEVER DEVICE TO EASE VALVE OPERATION ON LIQUID BAG CONTAINERS

BACKGROUND—FIELD OF INVENTION

Figure 1:
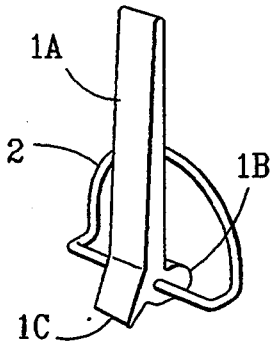

This invention relates to valve actuation connected to fluid containers, specifically vacuum bag fluid dispensing spigots.

BACKGROUND—DESCRIPTION OF PRIOR ART

Many liquids have traditionally been contained in glass bottles for sale, storage and consumption. This has been the preferred method of packaging for many years. The following are drawbacks of this packaging:

1. Glass bottles can allow ultra violet light to cause the: product to deteriorate prematurely.
2. Once a bottle has been opened, air is introduced to the product.
3. Bottles are an expensive form of packaging.

To avoid these problems, the vacuum bag-in-box packaging was developed. This system consists of an opaque storage bag filled with the liquid product, a rigid yet flexible dispensing valve at the bottom of the bag and a cardboard box which the bag is contained in for rigidity and protection from puncture.

By vacuum sealing the bag, air cannot get to the product. Also, the opaque packing prevents the adverse effects of ultra violet light. In addition to these advantages, the cost of vacuum bag packaging is lower than glass bottles.

The problem with this system is the physical actuation of the fluid dispensing valve. The dispensing valve is kept folded in the box until opened by the consumer, therefore the flexible dispensing valve must be recessed in the spigot housing and is very short.

This makes the valve difficult and uncomfortable for the consumer to use, often causing pain or discomfort in the finger or thumb that one uses to hold the valve open.

A thorough patent search found prior art in the design of a lever actuated mechanism. However, nothing of the same or even similar utility was found.

The patents of:

Benjamin U.S. Pat. No. 300,437 1884
Miller U.S. Pat. No. 491,728 1893
Latham et al U.S. Pat. No. 511,534 1893
Pitre U.S. Pat. No. 1,024,223 1912
Michelin U.S. Pat. No. De. 45,6,14 1914 all have a lever designed to exert a force against something else, however, none of these devices could be adapted for use in valve actuation of this type.

OBJECTS AND ADVANTAGES

Several objects and advantages of my invention are:

a) To provide easy operation of a difficult valve design;
b) to case use while providing an aesthetically pleasing addition to existing packaging;
c) to not add any substantial size or weight to existing packaging;
d) to be reusable from one package to the next;
e) to provide a highly visible space for labeling or advertising
f) to provide easy operation with wet, slippery or weak fingers.

Still further objects and advantages will become apparent from a consideration of the accompanying description and drawings.

DRAWING FIGURES

As seen in the drawings, there are 2 parts to the device in the preferred embodiment.

FIG. 1
Lever Arm—1*a*
Valve Actuating Cam—1*b*
Rotation Stop Tab—1*c*
Retaining Ring—2

Figure 2:
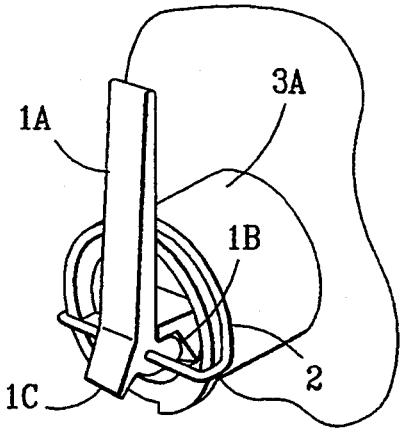

FIG. 2 Complete device installed, valve in the closed position

Figure 3:
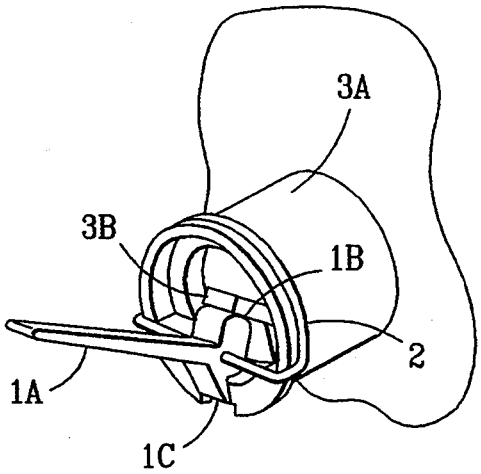

FIG. 3 Complete device installed, valve in the open position.

DESCRIPTION

A typical embodiment of the invention is illustrated in FIG. 1. A lever am (1*a*) has a valve lifting cam (1*b*) at the terminus. Opposite 1*b* is a Rotation Stop Tab (1*c*). A Retaining Ring (2) has a bridge passing laterally between 1*a* and 1*b* forming an axis for rotation of 1*a*.

In the preferred embodiment, lever 1*a* is a rigid plastic such as ABS or polystyrene, however lever 1*a* can be constructed of nylon, wood, metal or any other material that can be cut, molded or formed to the necessary specifications. Rotation stop 1*c* is essential to keep cam 1*b* from disengaging from flex valve 3*b*. Retaining ring 2 is "D" shaped and typically constructed of stainless steel wire, however; ring 2 can be made of virtually any metal or other material having similar rigidity or strength. Ring 2 fits over the existing spigot (FIG. 3*a*) and into a bore located on the lever arm between the valve lifting cam and the rotation stop tab. Ring 2 holds lever 1*a* in place so that cam 1*b* can move valve 3*b* an optimum distance for maximum fluid flow.

From the above description, a number of advantages of my lever device for valve actuation become evident:

a) by providing more leverage to the user, operation is eased;
b) it is not necessary for user to use 2 hands to acute the valve (3*b*);
c) construction of entire device can be of many inexpensive and available materials;
d) arm 1*a* provides a visible space for labels or advertising;
e) can be made to be reusable or disposable for repeat sales.

OPERATION

The manner of operation for the valve actuation lever is here described. Ring 2 is placed over spigot 3*a*. Cam 1*b* fits under flexible valve 3*b* with arm 1*a* pointing upwards vertically.

Ring 2 holds device in place so that arm 1*a* can be pulled away from spigot 3*a*. This action causes cam 1*b* to lift valve 3*b* allowing maximum fluid flow. When arm 1*a* is pulled down, Stop 1*c* contacts the surface of housing 3*a* to prevent overrotation. This keeps cam 1*b* in place under valve 3*b*.

Cam 1*b* lifts valve 3*b* allowing fluid flow, when released; valve returns to the dosed position due to the resiliency of the valve 3*b*. This is desirable to prevent leakage from container. The drawings show the invention in both the opened and closed positions.

SUMMARY RAMIFICATIONS AND SCOPE

Accordingly, the reader will see that the lever design of this invention will allow the consumer to dispense liquid from bag-in box containers much easier than the original spigot design found on most popular containers, specifically 4 and 5 liter bag-in box wine containers. In addition, the design of my lever device allows for easy installation and removal from one package to the next. The user can also color code, label or place a logo on the vertical arm of the lever device where it will be seen any time the product is used. Furthermore, my valve actuation lever has additional advantages such as:

a) providing one finger operation, b) not adding substantial size or weight to packaging.

c) provides simple operation with wet, slippery or weak fingers.

Although the description above provides many specificities, these should not be construed as limiting the scope of the invention but as merely providing illustrations of some of the presently preferred embodiments of the invention. For example, the lever device can be of other shapes such as elongated, oval, square or virtually any other shape. Likewise, the retaining ring can be constructed of different materials or diameters of material.

Thus the scope of the invention should be determined by the appended claims and their legal equivalents, rather than by the examples given.

I claim:

1. A lever device to actuate a fluid valve found on a vacuum bag fluid container, comprising:

a lever arm having a valve lifting cam for engaging a resilient component of the fluid valve;

a stop tab projecting outwardly opposite said valve lifting cam to prevent said lever arm from excess rotation during use;

a bore through said lever arm passing laterally between said valve lifting cam and said stop tab; and a D-shaped wire loop fitted within said bore for securing said lever arm to a top of the fluid valve installed on the vacuum bag.

* * * * *